US012560039B2

(12) United States Patent
Maclean et al.

(10) Patent No.: US 12,560,039 B2
(45) Date of Patent: Feb. 24, 2026

(54) CABLE SUSPENDING AND RECOVERY DEVICE AND METHOD FOR USE WITH TOOLS DEPLOYED IN SUBSURFACE WELLS

(71) Applicant: Schlumberger Technology Corporation, Sugar Land, TX (US)

(72) Inventors: Iain Maclean, Aberdeen (GB); Ivor Maciver, Belhelvie (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/948,875

(22) Filed: Nov. 15, 2024

(65) Prior Publication Data

US 2025/0163786 A1 May 22, 2025

Related U.S. Application Data

(60) Provisional application No. 63/599,649, filed on Nov. 16, 2023.

(51) Int. Cl.

| | |
|---|---|
| ***E21B 29/04*** | (2006.01) |
| ***E21B 23/14*** | (2006.01) |
| ***E21B 31/00*** | (2006.01) |
| ***E21B 43/12*** | (2006.01) |

(52) U.S. Cl.

CPC ..... *E21B 29/04* (2013.01); *E21B 23/14* (2013.01); *E21B 31/00* (2013.01); *E21B 43/128* (2013.01)

(58) Field of Classification Search

CPC ..... E21B 43/128; E21B 23/14; E21B 29/04; E21B 31/00; E21B 31/12

See application file for complete search history.

(56) References Cited

U.S. PATENT DOCUMENTS

| | | | | |
|---|---|---|---|---|
| 4,009,753 | A * | 3/1977 | McGill | E21B 29/04 166/55.1 |
| 4,522,370 | A * | 6/1985 | Noack | E21B 34/045 166/324 |
| 7,765,752 | B2 | 8/2010 | Hayes | |
| 2008/0169097 | A1 | 7/2008 | Bolding | |
| 2010/0051847 | A1 * | 3/2010 | Mailand | E21B 29/04 166/55 |

(Continued)

FOREIGN PATENT DOCUMENTS

| | | | |
|---|---|---|---|
| CN | 113494259 | A | 10/2021 |

OTHER PUBLICATIONS

Search Report and Written Opinion of International Patent Application No. PCT/US2024/056054 dated on Feb. 24, 2025, 9 Pages.

*Primary Examiner* — Brad Harcourt

(74) *Attorney, Agent, or Firm* — Jeffrey D. Frantz

(57) ABSTRACT

A method for deploying a tool in a well on an electrical cable comprises attaching a cable suspension and recovery device to the cable at a position chosen such that the device is disposed below a wellhead at an upper end of the well when the tool is disposed at a selected depth in the well. The device has a diameter larger than a landing profile disposed in the well, the device having a diameter enabling free movement through the well and flow of fluid around the device in the well. The tool is attached to an end of the cable. The tool is deployed in the well by extending the cable.

18 Claims, 4 Drawing Sheets

(56) References Cited

U.S. PATENT DOCUMENTS

| | | | | |
|---|---|---|---|---|
| 2010/0206577 | A1* | 8/2010 | Martinez | E21B 43/128<br>166/369 |
| 2019/0112888 | A1 | 4/2019 | Maclean | |
| 2023/0203910 | A1 | 6/2023 | Maciver | |
| 2023/0243228 | A1 | 8/2023 | Maciver | |
| 2024/0279995 | A1* | 8/2024 | Alghazali | E21B 29/04 |

* cited by examiner

CABLE SUSPENDING AND RECOVERY DEVICE AND METHOD FOR USE WITH TOOLS DEPLOYED IN SUBSURFACE WELLS

CROSS REFERENCE TO RELATED APPLICATIONS

This application claims benefit of U.S. Provisional Application No. 63/599,649 filed on Nov. 16, 2023.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of tools deployed in subsurface wells by a cable, such as armored electrical cable, tubing encapsulated cable, electric slickline and the like. More specifically, the disclosure relates to devices for facilitating closing in wells in the event of a safety hazard and subsequent recovery of severed cable and the well tool.

Subsurface wells used, for example, to extract fluids from underground formations or to pump fluids from surface into such formations may be "completed" by inserting a pipe ("casing" or "liner") from surface at least to the depth of the relevant underground formation to stabilize and protect the drilled wellbore and to hydraulically isolate the formation from other underground formations. A smaller diameter pipe ("tubing") may be nested within the protective pipe and may extend to the surface. A surface end of the tubing may have coupled thereto a "wellhead" comprising one or more valves. Such valves may be closed to hydraulically isolate the interior of the tubing and any portion of the well below the tubing from fluid communication to above the valves.

Tools may be deployed in such wells after completion. Some such tools may be deployed at the end of a cable, e.g., an electrical cable, e.g., armored electrical cable, tubing encapsulated cable, electric slickline and the like (hereinafter "cable" for convenience) by attaching the tool(s) to a free end of the cable and lowering the tool through the tubing into the well to a chosen depth. The cable may be terminated in some manner to enable permanent installation and operation of some types of tools, e.g., electric pumps. Other tools may remain in the well only for a specific, short-term operation.

In any case, such tools deployed in wells may be deployed by lowering the tool(s) and cable through the open upper end of the wellhead. Thus, the cable may extend through the one or more valves in the wellhead. In the event a hazardous condition takes place, e.g., an unintended discharge of fluid ("kick") from the well, it may be necessary to close the one or more of the wellhead valves ("master valve") to prevent further hazard and consequent damage. While the typical master valve is capable of severing a cable deployed therethrough and hydraulically closing the well, severing the cable in such manner can create a difficult situation to remedy. The portion of cable below the valve may drop into the well, and in the case of armored electrical cable in particular, may unwind as a result of relieved torque when the cable is severed. Subsequent recovery operations may be substantially hindered by the presence of dropped, unwound cable in the well.

There is a need for apparatus and methods to deploy tools in wells by cable that facilitate recovery operations in the event it becomes necessary to close a master valve on a wellhead when cable is deployed therethrough.

SUMMARY

One aspect of the present disclosure is a method for deploying a tool in a well by a cable. A method according to this aspect comprises attaching a cable suspension and recovery device to the cable at a position chosen such that the device is disposed below a wellhead at an upper end of the well when the tool is disposed at a selected depth in the well. The device has a diameter larger than a landing profile disposed in the well, the device having a diameter enabling free movement through the well and flow of fluid around the device in the well. The tool is attached to an end of the cable. The tool is deployed in the well by extending the cable.

Some embodiments further comprise closing at least one valve on the wellhead to sever the cable; making the well safe to reopen the at least one valve; reopening the at least one valve; and retrieving the cable and device from the well.

In some embodiments, the making the well safe comprises pumping fluid into the well to kill the well.

In some embodiments, the at least one valve comprises a master valve.

In some embodiments, the device comprises a housing having an upper segment and a lower segment releasably connectable to each other. The upper segment and the lower segment each comprises respective cable slips to engage a respective one of an upper portion and a lower portion of the cable and to transfer axial loading on the cable to the housing. The housing comprises a go-no go feature on an exterior having a diameter larger than a diameter of the housing and shaped to be stopped by the landing profile.

In some embodiments, the go-no go feature comprises at least one fluid flow passage therein to enable fluid in the well to traverse the housing when the device is disposed in the landing profile.

In some embodiments, at least the lower cable portion comprises a pressure resistant feedthrough bulkhead to exclude well fluid from entering the lower cable segment.

In some embodiments, the tool comprises an electric submersible pump.

A cable recovery and suspension device according to another aspect of the present disclosure includes a housing comprising an upper segment and a lower segment, wherein the upper segment is releasably connectable to the lower segment. The upper segment and the lower segment each comprise respective cable slips to transfer axial loading on a cable portion passing through the respective segment to the respective segment. The housing comprises a go-no go feature on an exterior surface of the housing. The go-no go feature has a diameter larger than a diameter of the housing. The feature is shaped to engage a landing profile in a well to prevent movement of the housing in the well beyond the landing profile.

In some embodiments, the housing comprises a sleeve interposed between the upper segment and the lower segment, the sleeve attached to the upper segment and the lower segment by cap screws.

Some embodiments further comprise a centralizer disposed on an exterior of the housing.

In some embodiments, the go-no go feature comprises at least one fluid passage therethrough.

Other aspects and possible advantages will be apparent from the description and claims that follow.

DETAILED DESCRIPTION

Figure 1:
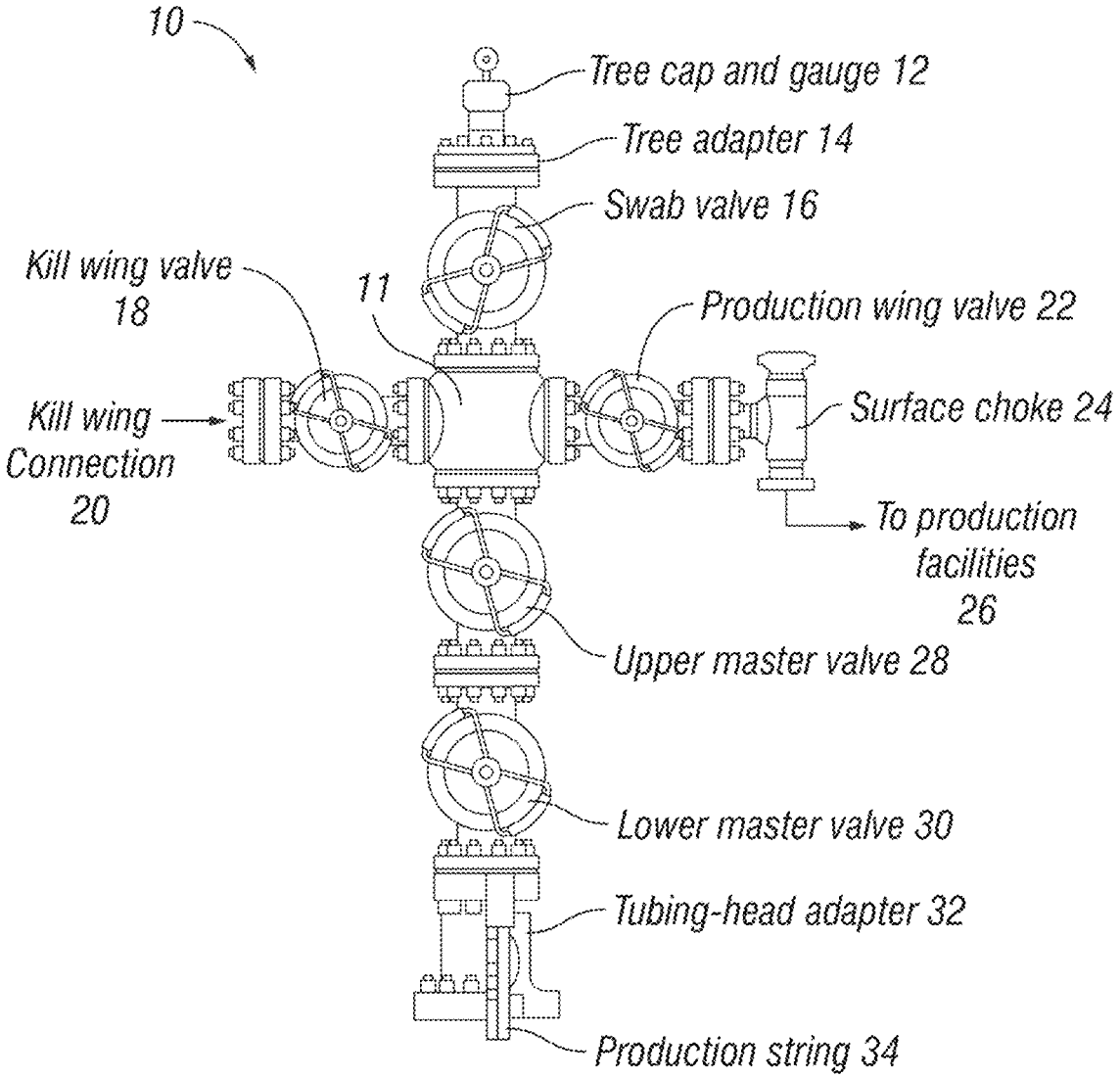
FIG. 1 shows an example wellhead that may be used in accordance with the present disclosure.

FIG. 1 shows an example implementation of a well surface control valve assembly ("tree") 10 that may be used in accordance with methods and apparatus according to the present disclosure. The tree 10 shown in FIG. 1 is a "flanged" tree that may be assembled from flange-coupled individual components, for example and without limitation, a tree cap and pressure gauge 12 coupled to an uppermost end of the tree 10, beneath which may be flange coupled, in downward order of their illustration vertically, a tree adapter 14, a swab valve 16, an adapter 11, an upper master valve 28, a lower master valve 30, a tubing head adapter 32 and the upper end of a production tubing string 34 (located internally to the tubing head adapter 32). The adapter 11 may have, on respective side ports, a kill wing valve 18 and associated kill line connection 20, and a production wing valve 22 and associated connection to a choke 24 and a connector to a flow line 26. Methods according to the present disclosure may begin by closing the master valves 28, 30, the wing valves 18, 22 and removing the tree adapter 14, and cap and pressure gauge 12 from the tree 10.

For purposes of describing methods according to the present disclosure, the well may be "completed", that is, casing or liner may be extended through an intended fluid producing reservoir formation; production tubing is nested within and installed in the casing or liner to a selected depth in the well; and the well otherwise is fully capable of producing fluid from an hydraulically connected subsurface reservoir, e.g., by perforating the casing or liner below the production tubing (see FIG. 2). A pump (not shown) may already be installed in such a well, e.g., at the base of the production tubing, or a naturally flowing well may have decreased fluid production such that installation of a pump is indicated.

Figure 2:
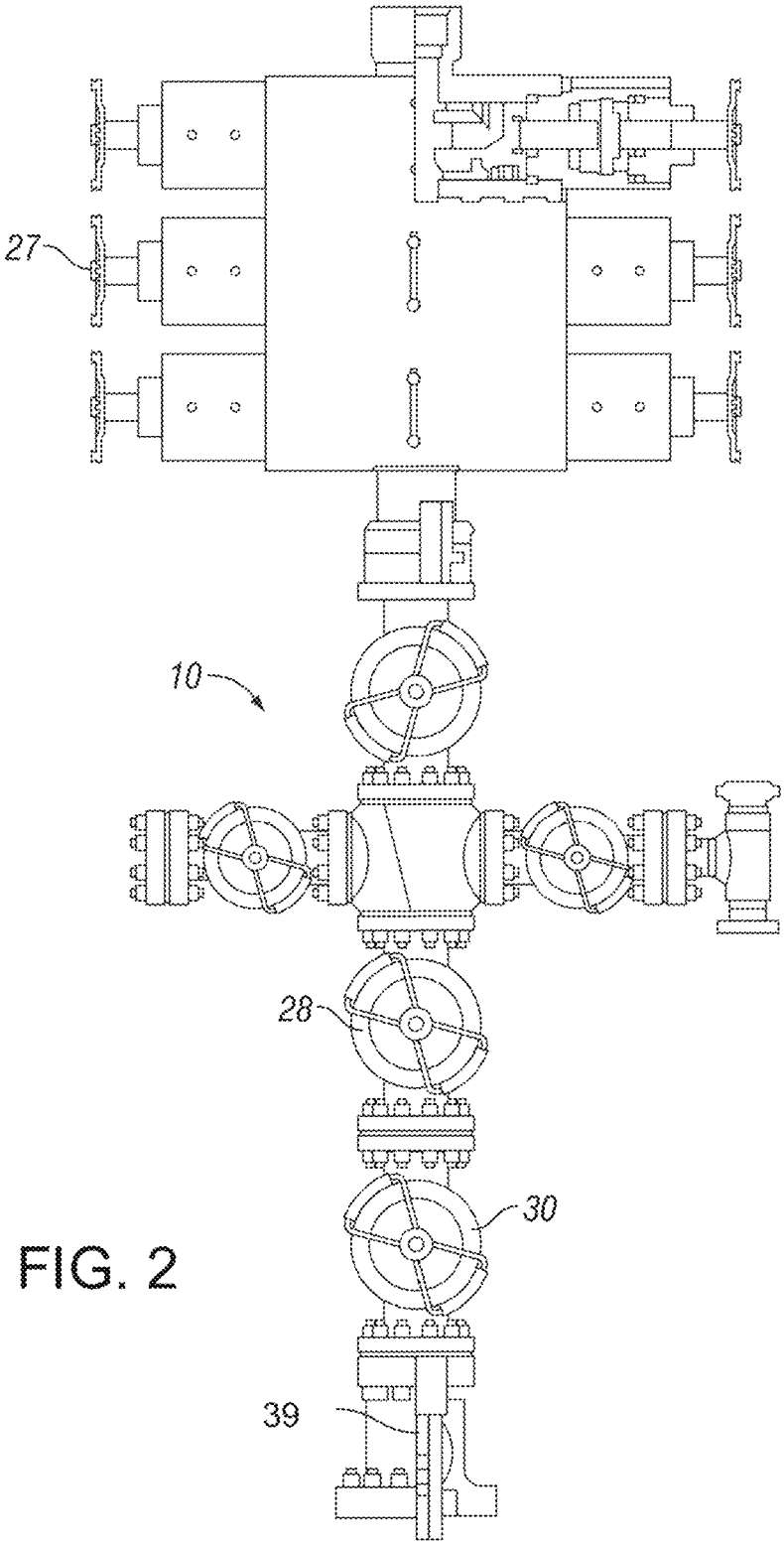
FIG. 2 shows a pressure control apparatus coupled to a top of the wellhead of FIG. 1 to deploy a tool in a subsurface well.

At the beginning of an example method according to this disclosure and referring to FIG. 2, the master valves 28, 30 may be closed and the tree adapter (14 in FIG. 1) and tree cap and gauge 12 may be removed. A pressure control assembly or "blowout preventer" (BOP) 27 may be coupled to the open top of the tree 10, e.g., an upper flange exposed by removing the tree cap and gauge 12. The blowout preventer ("BOP") 27 may comprise one or more sets of sealing elements called "rams", intended to close the well completely, close around a specific device extended through the BOP 27 such as pipe or a cable and to shear any such device passing through the BOP 27 in an emergency. A tube (shown at 42 in FIG. 3), called a lubricator, may be coupled to the upper end of the BOP 27, e.g., by a flange connection or a threaded connection, to enable fluidly enclosing components such as a pump, e.g., an electric submersible pump (ESP shown at 46, 48 in FIG. 3) above the tree 10 before reopening the master valves 28, 30, while maintaining the well fully closed to the external atmosphere. In some embodiments, a well plug or safety valve 39 in the form of a backpressure valve or other type of plug, or a valve, may be attached to a cable head 44 in FIG. 3) at the end of a cable, or a special valve setting tool, and inserted into the open end of the lubricator (42 in FIG. 3); other embodiments may omit the well plug or safety valve entirely or install the same in a different manner. The lubricator (42 in FIG. 3) may be reconnected to the BOP 27, the master valves 28, 30 reopened, and then the plug or safety valve 39 is moved through the tree 10 and is locked in place to seal the well below.

Figure 3:
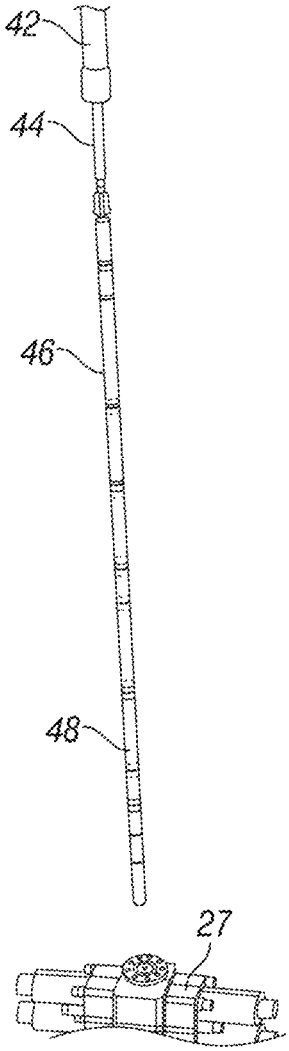
FIG. 3 shows hoisting equipment used to deploy a tool in the well by extending a cable into the well.
Figure 3:
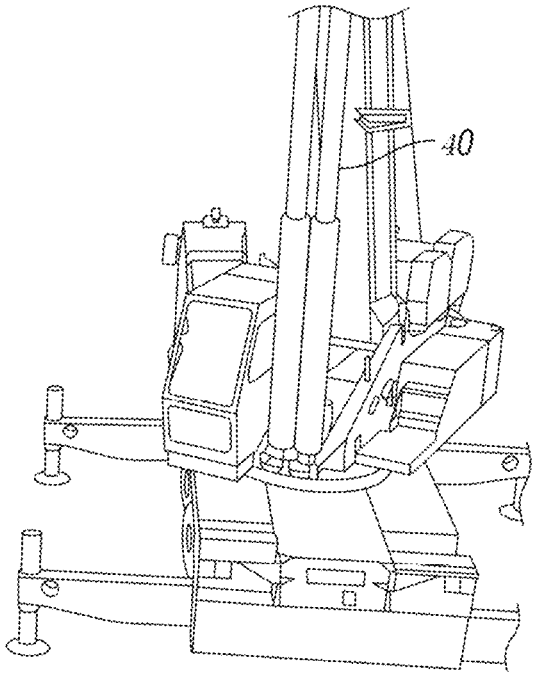

Referring to FIG. 3, the lubricator 42 may be suspended by a crane 40 or other suitable hoisting apparatus. The ESP, comprising a motor section and protector 46 and a pump section 48 may be connected to the cable by a cable head 44. The cable may be spooled from a winch (not shown) in any manner known in the art. Not shown in FIG. 3 a cable termination and penetrator (not shown) may be disposed within the cable at a selected position to enable suspending the cable in the wellhead (10 in FIG. 1) and to make electrical connections to one or more electrical conductors in the cable in a safely sealed manner. See, for example, U.S. Patent Application Publication No. 2023/0203910 filed by MacIver et al., the underlying application for which is assigned to the assignee of the present disclosure.

Figure 4:
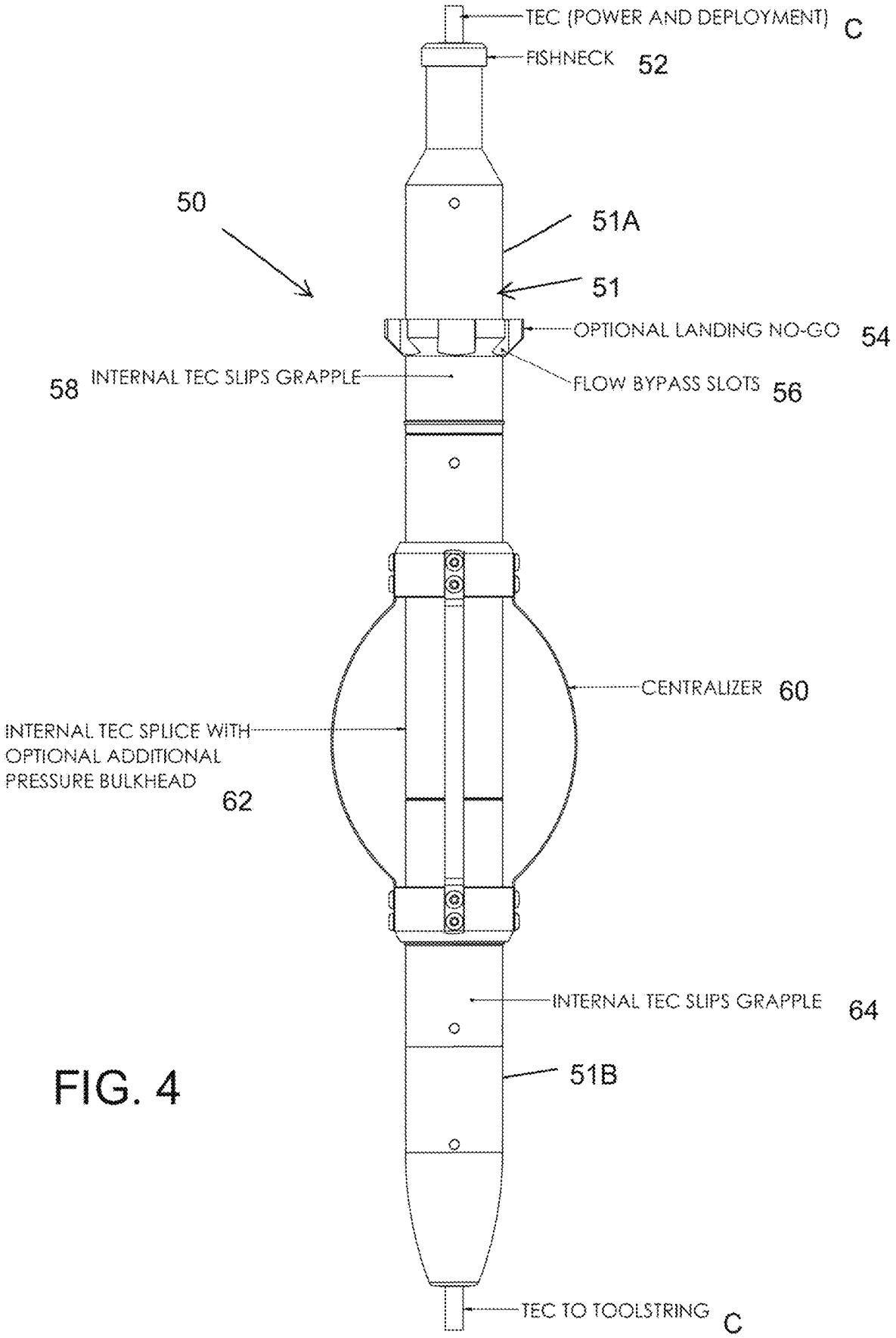
FIG. 4 shows an example of a cable suspending and recovery device according to the present disclosure

As explained in the Background section herein, in some circumstances, it may be necessary to close one or both master valves (28, 30 in FIG. 1), for example, in the event of an unexpected fluid influx ("kick") into the well, thereby severing the cable. An apparatus and method according to the present disclosure is intended to address such circumstances, making recovery of the severed cable and the attached well tool much easier. FIG. 4 shows an example implementation of a cable suspension and recovery device ("device") 50 that may be used in accordance with the present disclosure. The device 50 may comprise a housing 51 having an upper segment 51A coupled, e.g., by threaded connections to a lower segment 51B. In some embodiments, the upper segment 51A may be coupled to the lower segment 51B using a sleeve (not shown separately) attached to each segment 51A, 51B using capscrews or the like. The manner of connecting the segments 51A, 51B together is not a limitation on the scope of the present disclosure.

The cable C may be separated at a selected position wherein the device 50 is to be attached to the cable C, to create an upper cable portion and a lower cable portion. The upper portion of the cable C may extend through the upper segment 51A, and the lower portion of the cable C may extend through the lower segment 51B. The upper segment 51A and lower segment 51B each may comprise in an interior thereof, corresponding cable slips 58, 64, respectively, that, e.g., by friction transfer axial loading on the respective portion of the cable C to the respective housing segment 51A, 51B. The cable slips 58, 64 may be, for example and without limitation, in the form of circumferentially segmented wedges having an external tapered surface and internal gripping features to grip the exterior surface of the cable. See, for example, U.S. Pat. No. 7,765,752 issued to Hayes et al. for an illustration of friction wedges used to retain cable, rod or wire rope in tension and to transfer axial loading from such cable, rod or wire rope. It should be clearly understood that citation to the foregoing patent is made only to explain the principle of cable slips and is in no way intended to limit the scope of the present disclosure. "Upper" and "lower" are used herein only with reference to the orientation of the device 50 when it is affixed to a cable and installed in a well. The specific structures described herein may be interchangeable between the segments 51A, 51B.

The housing 51 may comprise on its upper end a fishing neck 52 or similar feature to facilitate recovery operations using an overshot and grapple of types well known in the art to attach a pipe or other tool assembly to the upper end of the housing 51 for recovery of the device 50 and attached cable C from a well. A centralizer 60 may be attached to an exterior of the housing 51 to locate the housing 51 approximately in the center of the well tubing to facilitate seating the housing 51 in a suitable receptacle (not shown) disposed in the well. In the present example embodiment, a cable splice with pressure resistant electrical feedthrough, shown generally at 62, may be provided such that fluid under pressure in the well may be prevented from entering and damaging the cable C. The housing 51 may comprise on its exterior a feature larger in diameter than the general diameter of the housing 51, so as to provide a landing "go-no go" 54. The go-no go 54 may engage a reduced internal diameter feature in the tubing (not shown), which may be referred to as a "landing profile," to prevent further downward movement of the housing 51 (and thus the cable C) once the go-no go 54 seats in the landing profile (not shown). The go-no go 54 may comprise one or more circumferentially spaced flow bypass slots 56 to enable fluid flow around the housing 51 when the go-no go 54 is seated in the landing profile.

In a method according to the present disclosure, the device 50 may be coupled into the cable C at a selected position before or during deployment of a well tool. The cable C may be extended to move the tool (not shown) into the well to its intended deployment position (depth). It is contemplated that the position of the device 50 when the tool is at its intended deployment depth is entirely below the wellhead (10 in FIG. 1), wherein only cable C extends through the wellhead (10 in FIG. 1). The device 50 may be located in the well such that the go-no go 54 is seated in the landing profile (not shown) or position above the landing profile (not shown) yet the device 50 is located below the wellhead (10 in FIG. 1).

In the event it becomes necessary to close, e.g., one of the master valve (28, 30 in FIG. 1), the cable C will be severed by reason of such closure. Depending on the position of the device 50 and the landing profile (not shown), the cable C may only move a relatively short distance downward into the well as tension is relieved, or not at all if the initial deployment of the tool results in the device 50 being seated in the landing profile. In any event, when recovery operations commence, only a limited length of the cable C will extend above the device 50, and therefore facilitate attaching suitable recovery ("fishing") tools to the severed portion of the cable C above the device, or to the device 50 itself, e.g., to the fishing neck 52. Thus, in an example embodiment of a method, the master valve(s) (28, 30 in FIG. 1) may be closed and the cable C severed. The well may be "killed" by pumping fluid into the well, e.g., through the kill wing valve (18 in FIG. 1). When the well is killed, and suitable pressure control equipment may be installed to the top of the wellhead, e.g., a BOP as shown at 27 in FIG. 1, it may then be safe to open the master valve(s) and commence recovery operations, e.g., attaching to the cable C or fishing neck 52 and removing the tool from the well.

In some embodiments, the tool may remain in the well, and the cable C may be spliced at a suitable intermediate position below the device 50. For example, the device 50 may be reattached to the well end of the cable C at a deeper position along the cable C, and the winch end of the cable C may be reconnected to the cable C and the device 50 reassembled. In some embodiments, a cable splice coupling (not shown) may be attached to the well end of the severed cable, an additional length of cable attached to the splice coupling, and the device 50 may then be reattached to such additional length of cable so as to position the device 50 in substantially the same position along the cable C as before the well event requiring closure of the master valve(s) (28, 30 in FIG. 1).

A cable suspending and recovery device, and a method according to the present disclosure may facilitate cable and tool recovery in the event it is necessary to sever the cable by closing a master valve or other well valve.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for deploying a tool in a well on an electrical cable, comprising:

attaching a cable suspension and recovery device to the cable at a first position chosen such that the device is disposed below a wellhead at an upper end of the well when the tool is disposed at a selected depth in the well, the device including a housing having an upper segment and a lower segment releasably connectable to each other, the upper segment and the lower segment each comprising respective cable slips to engage a respective one of an upper portion and a lower portion of the cable and to transfer axial loading on the cable to the housing, the housing including a go-no go feature on an exterior of the housing, and the go-no go feature having a diameter larger than a diameter of the housing and shaped to be stopped by the landing profile;

attaching the tool to an end of the cable; and deploying the tool in the well by extending the cable.

2. The method of claim 1, further comprising:

closing at least one valve on the wellhead to sever the cable;

making the well safe to reopen the at least one valve;

reopening the at least one valve; and retrieving the cable and device from the well.

3. The method of claim 2, wherein the making the well safe comprises pumping fluid into the well to kill the well.

4. The method of claim 2, wherein the at least one valve comprises a master valve.

5. The method of claim 2, wherein severing the cable comprises splicing the cable at an intermediate position below the device.

6. The method of claim 5, comprising:

attaching a cable splice coupling to a lower end of the severed cable; and attaching an additional segment of cable to the lower end of the severed cable via the cable splice coupling.

7. The method of claim 6, comprising reattaching the device to the additional segment of cable in a suitable location.

8. The method of claim 7, wherein the suitable location is located at approximately the first position.

9. The method of claim 1, wherein the go-no go feature comprises at least one fluid flow passage therein to enable fluid in the well to traverse the housing when the device is disposed in the landing profile.

10. The method of claim 1, wherein at least the lower cable portion comprises a pressure resistant feedthrough bulkhead to exclude well fluid from entering the lower cable portion.

11. The method of claim 1, wherein the tool comprises an electric submersible pump.

12. A cable recovery and suspension device, comprising:

a housing comprising an upper segment and a lower segment, wherein the upper segment is releasably connectable to the lower segment, the upper segment and the lower segment each comprising respective cable slips to transfer axial loading on a cable portion passing through the respective segment to the respective segment, the housing comprising a go-no go feature on an exterior surface of the housing comprising a diameter larger than a diameter of the housing, the feature shaped to engage a landing profile in a well to prevent movement of the housing in the well beyond the landing profile.

13. The device of claim 12, wherein the housing comprises a sleeve interposed between the upper segment and the lower segment, the sleeve attached to the upper segment and the lower segment by cap screws.

14. The device of claim 12, further comprising a centralizer disposed on an exterior of the housing.

15. The device of claim 14, wherein a diameter of the centralizer is larger than the diameter of the go-no go feature.

16. The device of claim 12, wherein the go-no go feature comprises at least one fluid passage therethrough.

17. The device of claim 12, wherein the go-no go feature comprises one or more circumferentially spaced slots disposed around the exterior surface of the housing.

18. The device of claim 17, wherein the one or more circumferentially spaced slots are spaced approximately equidistantly around the exterior surface of the housing.

* * * * *